United States Patent [19]

Lenk et al.

[11] Patent Number: 4,698,008

[45] Date of Patent: Oct. 6, 1987

[54] MELT SPINNING APPARATUS

[75] Inventors: Erich Lenk; Max Feth, both of Remscheid, Fed. Rep. of Germany

[73] Assignee: Barmag AG, Remscheid, Fed. Rep. of Germany

[21] Appl. No.: 746,975

[22] Filed: Jun. 20, 1985

Related U.S. Application Data

[63] Continuation-in-part of Ser. No. 738,170, May 24, 1985, which is a continuation-in-part of Ser. No. 593,034, Mar. 23, 1984, Pat. No. 4,645,444.

[30] Foreign Application Priority Data

Jun. 22, 1984 [DE] Fed. Rep. of Germany ..... 3423087
Jul. 17, 1984 [DE] Fed. Rep. of Germany ..... 3426211

[51] Int. Cl.[4] ..... D01D 4/08

[52] U.S. Cl. ..... 425/192 S; 264/176.1; 425/378 S; 425/379 S; 425/464

[58] Field of Search ..... 425/72 S, 182, 192 S, 425/378 S, 378 R, 379 R, 379 S, 382.2, 131.5, 461, 464, 197, 198, 190; 264/176 F, 176.1, 211.12, 211.14, 211.2

[56] References Cited

U.S. PATENT DOCUMENTS

| | | | |
|---|---|---|---|
| 2,786,504 | 3/1957 | Samler | 137/547 |
| 2,838,084 | 6/1958 | Samler | 137/15 |
| 2,923,970 | 2/1960 | Genovese | 264/176 F |
| 3,104,419 | 9/1963 | Forge | 425/198 |
| 3,130,448 | 4/1964 | Tomlinson | 264/176 F |
| 3,407,437 | 10/1968 | Lenk | 425/464 |
| 3,466,357 | 9/1969 | Schippers et al. | 264/176 F |
| 3,480,995 | 12/1969 | Lenk | 425/464 |
| 3,500,499 | 3/1970 | Goossens | 425/192 R |
| 3,516,119 | 6/1970 | Keller | 425/191 S |
| 3,559,237 | 2/1971 | van den Biggelaar | 425/131.5 |
| 3,562,858 | 2/1971 | Lehner | 425/379 |
| 3,655,314 | 4/1972 | Lenk et al. | 425/378 S |
| 3,667,886 | 6/1972 | Gauthier et al. | 425/192 S |
| 3,762,854 | 10/1973 | Kilsdonk | 425/382.2 |
| 3,891,379 | 6/1975 | Lenk | 425/464 |
| 4,035,127 | 7/1977 | Ogasawara et al. | 425/378 S |
| 4,038,005 | 7/1977 | Lenk | 425/190 |
| 4,050,866 | 9/1977 | Kilsdonk | 425/192 S |
| 4,084,930 | 4/1978 | Neveu et al. | 425/378 S |
| 4,099,898 | 7/1978 | Beck | 425/192 S |
| 4,285,651 | 8/1981 | Fetchu et al. | 425/192 R |
| 4,321,228 | 3/1982 | de Kok | 264/209.8 |
| 4,413,968 | 11/1983 | Bliss | 425/198 |
| 4,437,827 | 3/1984 | Moderlak et al. | 425/378 S |
| 4,494,921 | 1/1985 | Sowell | 264/176 F |

FOREIGN PATENT DOCUMENTS

| | | | |
|---|---|---|---|
| 37-6403 | 6/1962 | Japan | 425/191 S |
| 44-22524 | 9/1969 | Japan | 425/198 |
| 53-02618 | 1/1978 | Japan | 425/192 S |
| 842758 | 7/1960 | United Kingdom | 425/198 |
| 1350496 | 4/1974 | United Kingdom . | |

OTHER PUBLICATIONS

W. H. Hills, "Anatomy of a Spin Beam", *Fiber Producer,* Dec. 1981, pp. 34, 36, 38, 40, 42, and 43.

*Primary Examiner*—Jay H. Woo
*Assistant Examiner*—J. Fortenberry
*Attorney, Agent, or Firm*—Bell, Seltzer, Park & Gibson

[57] ABSTRACT

A melt spinning apparatus is disclosed which comprises an elongate heating chamber having a generally U-shaped outline in cross section and so as to define two parallel leg sections of hollow, double wall construction, and an intermediate leg section extending between the two parallel leg sections which is also of hollow, double wall construction in several of the disclosed embodiments. A plurality of longitudinally spaced apart tubular nozzle casing receptacles extend vertically through the bottom one of said leg sections, and a pump block rests upon such bottom one of the leg sections so as to completely cover each of the casing receptacles. Each pump block includes a connecting plug aligned with each of the receptacles for releasably mounting a nozzle assembly within each of the receptacles, and the pump block is connected to a metering pump which is disposed between the parallel leg sections for pumping the melt through the melt supply lines of the pump block and to the nozzle assembly. In one embodiment, the parallel leg sections of the U-shaped heating chamber are disposed horizontally, and in another embodiment the parallel legs are disposed vertically. In each case, each nozzle assembly may be readily released from the associated connecting plug and withdrawn vertically downwardly through the associated receptacle.

14 Claims, 7 Drawing Figures

MELT SPINNING APPARATUS

BACKGROUND OF THE INVENTION

This is a continuation-in-part of copending application Ser. No. 738,170, filed May 24, 1985, which in turn is a continuation-in-part of copending application Ser. No. 593,034 filed Mar. 23, 1984, now U.S. Pat. No. 4,645,444.

The present invention relates to a melt spinning apparatus for extruding and spinning thermoplastic material, and more particularly to a melt spinning apparatus which includes a nozzle assembly attached thereto in such a manner as to be easily removable and replaceable.

U.S. Pat. No. 3,655,314 discloses an elongated spin beam which includes a double-walled heating chamber and which is designed and constructed as a pressure vessel to receive a heating medium, such as steam. The heating chamber includes upwardly open sections, having plane parallel machined heating surfaces for the accommodation and heat transfer connection of the structural units for the delivery of the melt, such as pump blocks, metering pumps, and heat conducting blocks, if necessary. The heating chamber of the spin beam is accommodated in a casing and enclosed by heat insulation.

In the known spin beam, the structural units for the passage of the melt are arranged on a double-walled heating chamber in the form of a heated plate, which may be plane or have L-shape or U-shape in cross section. Heat conducting filling bodies are mounted above the plate to form a closed hollow beam. All of the structural units for the passage of the melt must be inserted from the top, for which purpose it is necessary to remove the insulating pieces and the corresponding filling bodies. By reason of manufacturing tolerances and different heat expansion rates, there may be gaps of varying width between the insulating and filling bodies, through which heat may escape in an uncontrolled manner by reason of the chimney effect. This in turn may lead to a variable heating of the melt at the different spinning positions of the spin beam. Further, the removal or maintenance of the melt conducting structural units must be performed from an overhead position, and a platform above the spin beam is needed from which the operating personnel can perform such installation and maintenance work.

German patent PS No. 21 20 600 suggests that the extruder may be arranged below the spin beam in for example a one story spinning plant, so as to reduce the room height for the plant or to make it available for the blowing zone and yarn cooling. It is thus disadvantageous if the room height needs to be increased by reason of the necessary accessibility of the melt conducting structural units of the spin beam.

It is accordingly an object of the present invention to provide a melt spinning apparatus of the described type in which the maintenance and removal of the melt conducting structural units, including the spin blocks, can be performed from below or at one side of the beam, for the purpose of reducing the overall height of the spinning system, and so as to eliminate the need for a work platform above the spin beam.

SUMMARY OF THE INVENTION

This and other objects and advantages of the present invention are achieved in the embodiments illustrated herein by the provision of a melt spinning apparatus which comprises an elongate heating chamber which includes a bottom portion of hollow, doubled wall construction extending along its length, and which further includes a plurality of cylindrical nozzle casing receptacles extending vertically through such bottom portion and so as to extend between the double walls thereof. Pump block means rests upon the bottom portion of the heating chamber so as to completely cover each of the nozzle casing receptacles, with the pump block means including a connecting plug mounted thereto and aligned with each of the receptacles. A melt supply line also extends through the pump block means and each of the connecting plugs. The apparatus further includes a nozzle assembly mounted within each of the receptacles, with each of the nozzle assemblies including a spin plate having a plurality of openings extending therethrough, and a casing enclosing and supporting the spin plate. Means are provided for releaseably interconnecting the casing to the associated connecting plug, and such that the melt supply line communicates with the openings of the spin plate, and wherein the casing may be released from the connecting plug to permit removal of the nozzle assembly downwardly through the receptacle.

The present invention also has the advantage that all melt conducting structural units may be uniformly and adequately heated, and that vertical separating joints between the components within the heating chamber and the heat insulation are avoided. This advantage is achieved in that the heating chamber preferably has a U-shaped cross section defining two generally parallel, spaced apart and hollow leg sections, as well as an internal cavity which accommodates the melt conducting structural units and which is formed between the leg sections of the chamber. Also, the component receiving cavity is closed off from the nozzle casing receptacles which extend through the heating chamber by the pump block means, and the component receiving cavity is accessible in one embodiment from the side of the apparatus, which permits a reduction in the overall height thereof. Further, the nozzle assemblies are inserted through the nozzle casing receptacles from below, and as a result, a work platform above the spin beam is unnecessary.

In order to be able to mount the nozzle assemblies in a simple manner, the present invention further includes a novel means for releaseably interconnecting the nozzle assembly with the connecting plug of the associated pump block means. In particular, this interconnection means may comprise an external thread or a bayonet type lock formed therebetween and as further described in copending application Ser. No. 738,170. The connecting plug may for example be bolted to the pump block means, or it may comprise an integral part thereof. Further, the connecting plug is preferably mounted in a recess in the pump block means, so that its lower face is at a level above the surface of the adjacent portion of the heating chamber. Thus the connecting plug need not be disassembled when the pump block is to be laterally removed. Rather, the pump block may be inserted and/or removed with the connecting plug attached thereto, through the component receiving cavity defined between the U-shaped leg sections of the heating chamber.

It is also possible to construct the heating chamber from two mechanically separate heating chamber components, while maintaining the above mentioned advantages of the present invention. In such case, the two separate heating chamber components compliment each other in their cross section to form the leg segments of a U, and they define a flat, continuous separating surface extending along each of the leg sections. This construction has the advantage that during assembly of the apparatus, the melt conducting structural units may be carefully placed on one leg section of the spin beam, and the two mechanically separate leg sections can then be tightly secured to each other and with the melt conducting structural units therebetween, to thereby substantially avoid air gaps between the heat conducting surfaces.

In another embodiment, the heating chamber of the spin beam has a double walled construction of substantially circular cross section. This construction has the advantage that the external wall of the heating chamber may be of relatively small thickness.

BRIEF DESCRIPTION OF THE DRAWINGS

Some of the objects and advantages of the present invention having been stated, others will appear as the description proceeds when taken in conjunction with the accompanying drawings, in which.

DESCRIPTION OF THE PREFERRED EMBODIMENTS

Figure 1:
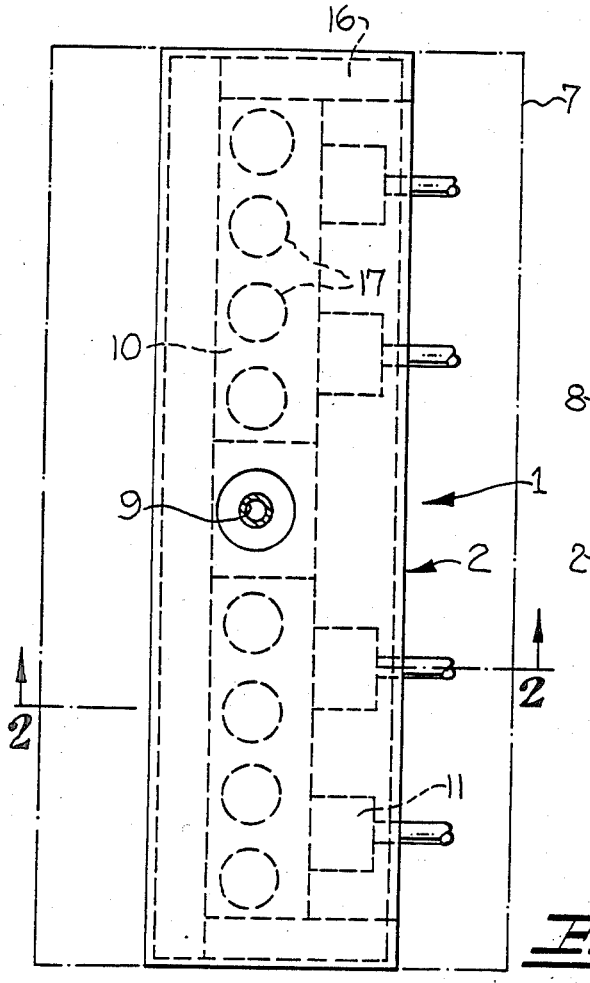
FIG. 1 is a plan view of a melt spinning apparatus which embodies the features of the present invention.
Figure 2:
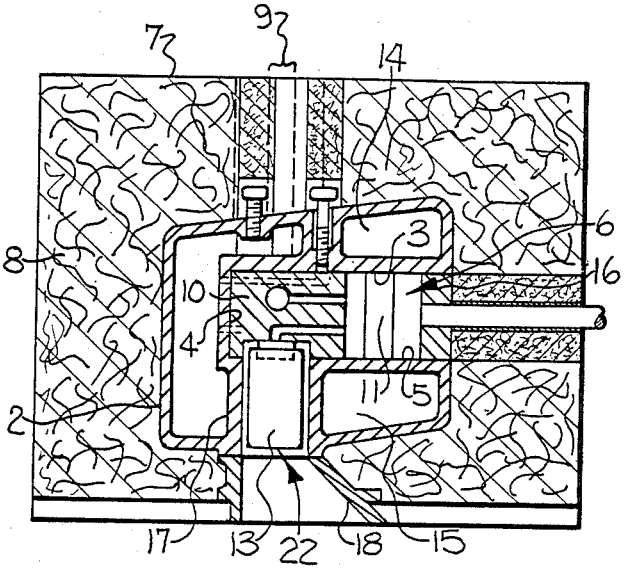
FIG. 2 is a sectional view taken substantially along the line 2—2 of FIG. 1.
Figure 3:
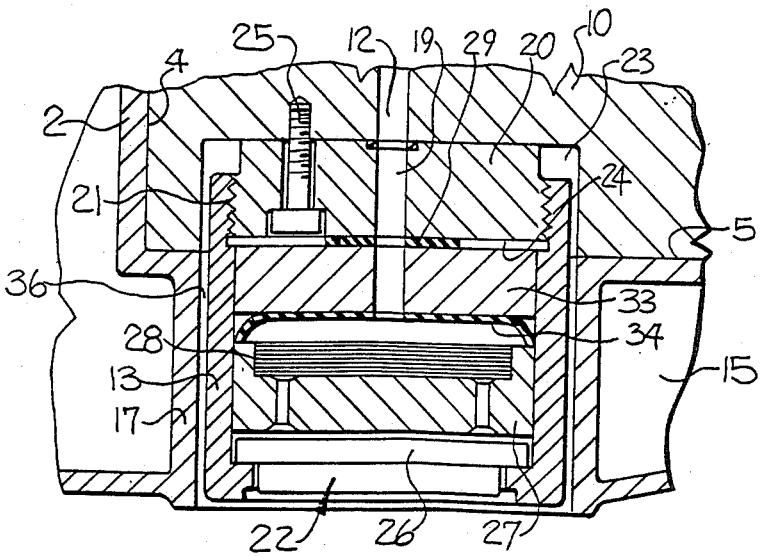
FIG. 3 is a fragmentary sectional view illustrating the nozzle assembly and its interconnection to the connecting plug of the pump block.

Referring more particularly to the drawings, FIGS. 1–3 illustrate a preferred embodiment of the invention and which comprises a melt spinning apparatus generally indicated at 1, and which includes an elongate heating chamber 2 in the form of a double wall jacket of U-shaped outline. More particularly, the heating chamber 2 includes two generally parallel, horizontally extending and vertically spaced apart leg sections 14 and 15, and a connecting leg section at the left side, as seen in FIG. 2. Each of the leg sections is of hollow, double wall construction, and the interior walls 3, 4, and 5 of the leg sections are generally flat and define a U-shaped interior cavity 6. The cavity 6 extends along the entire length of the heating chamber, and is closed at its ends by heat transfer blocks in the form of insulating pieces 16 (FIG. 1). The surfaces 3 and 5 are parallel to each other and are preferably machined so as to be very smooth, to facilitate heat transfer to the internal components as described below.

The chamber 2 is designed and constructed as a pressure vessel and it is adapted to receive a pressurized heat transfer medium, such as vaporous diphenyl. To avoid heat losses, the heating chamber is totally enclosed by a sheet metal casing 7, which is filled with mineral wool 8 or other suitable insulating material. At certain places where access is needed to the interior of the apparatus for the purpose of servicing, the insulating material is composed of insulating bodies formed into geometrically simple shapes, which can be removed through closeable recesses in the sheet metal casing.

A heated melt supply line 9 extends vertically through the top of the sheet metal casing 7 and leads from a suitable melt supply apparatus, such as an extruder or a discharge pump (not shown). The melt supply line 9 extends through the upper leg section 14 of the heating chamber 2, and is connected to a distributor block, from which branch ducts lead to the central ducts of the adjacent pump blocks 10. In each pump block 10, a conduit branches off from this central duct to the suction side of a melt metering pump 11 mounted to the pump block 10, and at least one outlet duct 12 extends through the pump block to each nozzle assembly 22.

The cavity 6 accommodates the melt conducting structural units, including the pump blocks 10, melt metering pumps 11, and the melt distributing block. The melt conducting structural units contact the heat transfer surface 5 of the leg section 15 over their entire opposing surfaces, and the units are preferably pressed against the surface 5 by additional bolts or the like (not shown) so as to further improve the transfer of heat to the structural units.

The heating chamber further includes a plurality of cylindrical nozzle casing receptacles 17 extending vertically through the leg section 15 and so as to extend between the double walls thereof. Four receptacles 17 are provided for each pump block 10 as shown in FIG. 1, and they may be welded in a pressure tight manner to each of the walls of the chamber. Thus the receptacles 17 extend vertically from the cavity 6 downwardly through the bottom portion of the chamber, which in the embodiment of FIGS. 1–3 is the lower leg section 15. Also, the juxtaposed nozzle casing receptacles 17 may be part of a common structural unit which extends along the entire length of the apparatus 1, and which is welded to the remaining portions of the heating chamber 2.

Below the nozzle casing receptacle 17, there is provided a widened portion 18, so as to provide better access to the nozzle assemblies 22. The widened portion may include downwardly extending cooling passages (not shown) joined thereto, and the widened portion 18 may also serve to support and mount the apparatus 1 on a support beam of a work platform or the like.

As best seen in FIG. 3, the pump block 10 includes a preferably cylindrical recess 23 positioned on its underside and in alignment with each of the receptacles 17. A connecting plug 20 is positioned in each of these recesses 23 in a pressure tight manner, and each connecting plug has a circular cross sectional outline and contains a central melt supply line 19 which is in alignment with the line 12 in the pump block 10. As illustrated, the connecting plug 20 is a separate component from the block 10, and is joined thereto by a number of mounting bolts 25. Also, it should be noted that the lower face 24 of the connecting plug 20 is at an elevation slightly above the heat transfer surface 5 of the lower leg section 15 of the heating chamber 2. This arrangement permits the lateral removal and insertion of the pump block 10, from and into the cavity 6. Thus no assembly work needs to be done on the connecting plug 20 through the nozzle casing receptacle 17.

A nozzle assembly 22 is mounted within each of the receptacles 17, so as to be accessible and removable from below to permit cleaning or replacement. Each nozzle assembly 22 includes an outer tubular casing 13 having a cylindrical bore and a shoulder at the lower end of the bore. The casing 13 encloses and supports a spin plate 26 having a plurality of openings extending therethrough, and a distribution plate 27 also having a plurality of openings extending therethrough. The distribution plate 27 includes an upwardly extending cylindrical outer wall which defines a cup-like receptacle which receives a filter 28, and the casing 13 and plate 27 define a cavity above the plate 27.

Each of the casings 13 is tubular and has a circular internal bore which is adapted to coaxially receive the associated connecting plug 20 therein. Also, the connecting plug and bore of the casing include cooperating threads 21 for permitting the casing, and thus the entire nozzle assembly 22, to be easily released from the associated connecting plug and withdrawn vertically downwardly through the associated receptacle 17. The threaded interconnection may, if desired, be of the bayonet joint type as further described in copending application Ser. No. 738,170, and so that the nozzle assembly 22 may be pushed upwardly onto the connecting plug 20 and tightened by turning the nozzle casing 10 a partial turn.

In order to provide for a pressure resistant and tight connection between the nozzle assembly and the connecting plug 20, there is provided a piston 33 which is positioned in the cavity above the cup-like receptacle of the plate 27, so that the piston 33 forms the upper end portion of the nozzle assembly. The piston 33 is mounted to permit limited axial movement between the plate 27 and connecting plug 20. Also, the piston includes a through duct which is in alignment with the duct 19 in the plug 20, and the piston 33 is sealed against the upper edge of the cylindrical wall of the plate 27 by an inverted plate-shaped sealing diaphragm 34. The diaphragm 34 has an opening in alignment with the duct in the piston 33, and an annular sealing gasket 29 is provided between the upper end of the piston 33 and the lower end of the connecting plug 20. The annular sealing gasket 29 is also in coaxial alignment with the supply duct 19 in the plug 20 and the duct in the piston 33. Thus the diaphragm acts to bias the piston 33 against the connecting plug 20 upon pressurized melt being received in the cavity above the plate 27.

As a particular aspect of the present invention, it will be noted that there will be an absence of heat losses by air circulation or due to a chimney effect, despite the presence of an annular gap 36 which remains between the nozzle casing 13 and receptacle 17 and which is necessary for assembly purposes. Such air circulation is precluded in these air gaps since the receptacles are sealed at their upper ends by the pump block 10. Thus there is essentially no movement of air in these receptacles, caused by the heat of the assembly.

Another feature of the present invention is the fact that the mounting of the nozzle casing 13 to the connecting plug 20 does not require the heating chamber 2 to absorb the tensions resulting from the pressure of the melt. This is of particular advantage with respect to the dimensioning of the wall thickness of the heating chamber.

Figure 4:
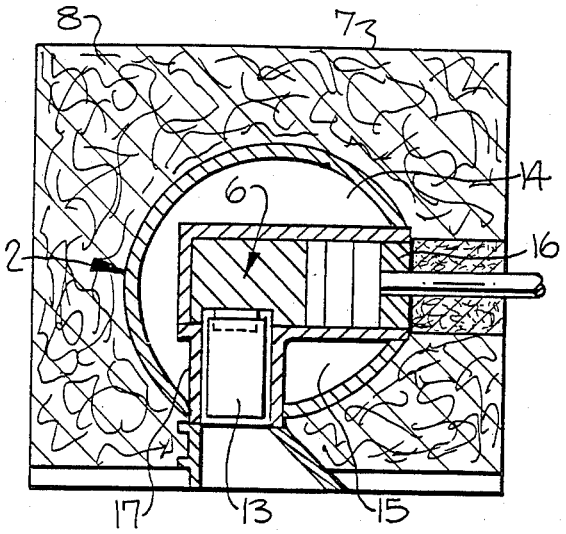
FIGS. 4–7 are sectional views each illustrating a modified embodiment of a melt spinning apparatus in accordance with the present invention.

FIG. 4 is a cross-sectional view of another embodiment of a melt spinning apparatus in accordance with the present invention. In this embodiment, the external wall of the heating chamber 2 has an essentially circular outline in cross section and comprises, for example, two sections which are cut in the longitudinal direction. The chamber 2 has a size or diameter sufficient to reach the outer ends of the horizontal cavity 6, which accommodates the melt conducting structural units, and it also reaches the outer ends of the nozzle casing receptacles 17 which extend through the chamber. This embodiment is simple in the sense of production engineering, and it is advantageous with respect to the stress caused by the heat transfer medium. As in the initial embodiment, suitable bolts (not shown) may be provided for pressing the melt conducting structural units to the flat heat transfer surfaces of the cavity 6, to improve the transfer of heat.

Figure 5:
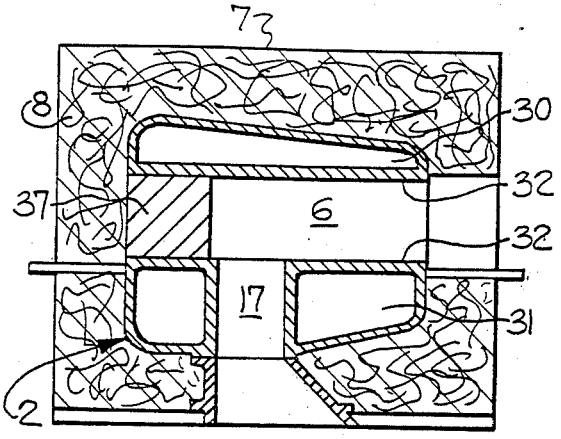
Figure 6:
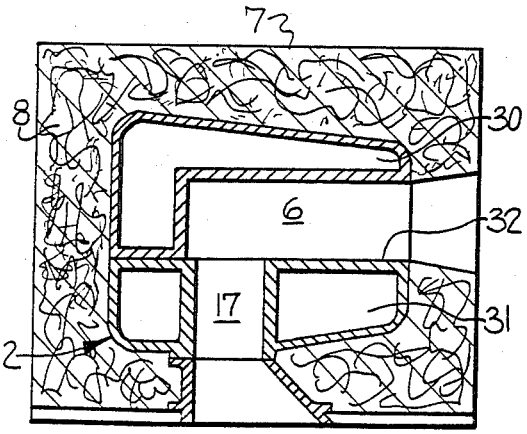

FIGS. 5 and 6 are schematic cross-sectional views of further embodiments of the present invention, and in which the heating chamber 2 is composed of two mechanically separate heating chamber leg sections 30 and 31. These leg sections have opposing flat surfaces 32 which are vertically separated to define the cavity 6, and in both embodiments, the flat separating surface 32 of the lower leg section 31 mounts all of the melt conducting structural units of the melt spinning apparatus. When assembling the apparatus 1 all of the melt conducting structural units are placed on the separating surface 32 of the lower leg section 31, and the other leg section 30 is then placed on top of the units and secured. In the embodiment of FIG. 5, a U-shaped cross section is obtained for the heating chamber by reason of a heat conducting block 37 which extends along the length of the heating chamber 2, and is secured to the surfaces 32 of the heating chambers 30 and 31 while also clamping the melt conducting structural units. In FIG. 6, the leg section 30 has an L-shaped cross-sectional configuration to provide the overall U-shaped configuration for the chamber.

All of the embodiments illustrated in FIGS. 1–6 have as a common feature in the fact that a horizontally oriented cavity 6 is defined between the leg sections 14 and 15 (or 30, 31) of the heating chamber, with the cavity 6 permitting the lateral insertion of the pump blocks 10 and melt metering pumps 11. This arrangement also facilitates the insertion of the nozzle casing receptacle 17 into the lower leg section 15 (or 31). It should also be noted that the leg sections 14 and 15, and 30 and 31 are interconnected, and that the constructional details with regard to the heating of the jacket have not been illustrated for the sake of clarity of illustration and since it is not relevant to the understanding of the present invention.

Figure 7:
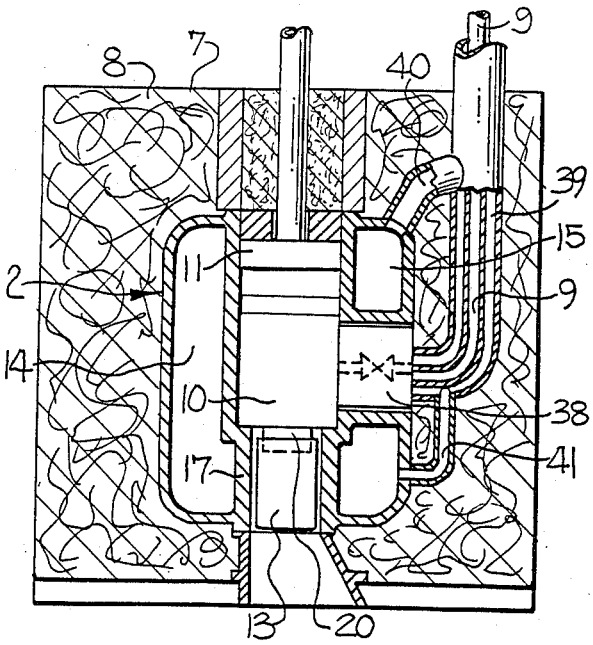

FIG. 7 illustrates the cross section of still another embodiment of the present invention, and in this embodiment, the leg sections 14, 15 of the U-shaped heating chamber 2 are vertically oriented and horizontally spaced apart, and such that the chamber 2 includes a bottom portion which extends horizontally between the leg sections 14, 15. The bottom portion is also of hollow, double wall construction. The nozzle casing receptacles 17 extend vertically downwardly from the cavity 6 through the bottom portion of the chamber and are joined, for example, by welding to each of the two walls of the bottom portion. In this embodiment, the pump block 10 and the melt metering block 11 are inserted into the pump cavity 6 vertically from above. In addition, the nozzle casing receptacles 17 are tightly closed at their upper ends by the pump block 10, which substantially extends over the entire length of the melt spinning apparatus 1, so that air circulation from a chimney effect is essentially avoided. The pump block 10 further has on the melt discharge side a corresponding number of connecting plugs 20, which form a common structural unit with the block 10, or they may be connected in a pressure tight manner by threaded members as described above. The nozzle casings 13 are threaded to the connecting plugs 20 as described above, so that the forces of the melt are absorbed only by the block 10 and nozzle casing 13, and the forces do not stress the heating chamber 2 and the nozzle casing receptacles 17.

In the embodiment of FIG. 7, the polymer melt is supplied through laterally directed melt supply line 9 which terminates in a valve block 38 or the like. The block 38 is in turn connected to the pump block 10 and extends through the vertical leg section 15 of the double walled heating chamber 2. The annular space 39 surrounding the melt supply line is connected with the leg section 15 of the chamber via tap lines 40, 41, and the line 41 may, for example, be used to drain the condensate which accumulates in front of the valve block 38.

In the drawings and specification, there have been set forth preferred embodiments of the invention, and although specific terms are employed, they are used in a generic and descriptive sense only and not for purposes of limitation.

That which is claimed is:

1. A melt spinning apparatus adapted for dividing a molten polymer into a plurality of streams to form synthetic filaments, and comprising an elongate heating chamber which includes a bottom portion of hollow, double wall construction and which defines an upper surface, and a plurality of longitudinally spaced apart nozzle casing receptacles extending vertically through said bottom portion of said chamber, pump block means resting upon said upper surface of said bottom portion of said heating chamber so as to completely cover each of said nozzle casing receptacles, with said pump block means including a bottom surface opposing said upper surface of said bottom portion, and a plurality of cylindrical connecting plugs directly mounted to said bottom surface and aligned with respective ones of said receptacles, and further including a melt supply line extending through said pump block means and each of said connecting plugs, and a nozzle assembly mounted within each of said receptacles, with each of said nozzle assemblies including a spin plate having a plurality of openings extending therethrough, a tubular casing enclosing and supporting said spin plate, and thread means formed on the associated cylindrical connecting plug and casing for releasably interconnecting said casing to the associated connecting plug and such that said melt supply line communicates with said openings of said spin plate, and whereby each nozzle assembly may be released from the associated connecting plug by rotation of said casing with respect to said plug and withdrawn vertically downwardly through the associated receptacle.

2. The melt spinning apparatus as defined in claim 1 wherein each of said heating chamber is of generally U-shaped cross section so as to define two generally parallel, spaced apart and hollow leg sections of double wall construction.

3. The melt spinning apparatus as defined in claim 2 wherein the opposing surfaces of said leg sections include portions which are substantially flat and parallel to each other along the length of said chamber.

4. The melt spinning apparatus as defined in claim 3 further comprising metering pump means mounted between said opposing surfaces of said leg sections, with said metering pump means communicating with each of said melt supply lines of said pump block means.

5. The melt spinning apparatus as defined in claim 2 wherein said leg sections extend generally horizontally and are vertically spaced apart, and such that said bottom portion of said chamber comprises the bottom one of said leg sections.

6. The melt spinning apparatus as defined in claim 5 wherein said leg sections are mechanically separate, and said heating chamber further comprises a solid heat conducting block extending between said leg sections.

7. The melt spinning apparatus as defined in claim 5 wherein each of said connecting plugs includes a lower face which is disposed at a level above said upper surface of said bottom portion of said heating chamber.

8. The melt spinning apparatus as defined in claim 2 wherein said leg sections extend generally vertically and are horizontally spaced apart, and such that said bottom portion of said chamber extends horizontally between said leg sections.

9. The melt spinning apparatus as defined in claim 8 further comprising melt supply valve means extending horizontally through one of said leg sections and communicating with each of said melt supply lines of said melt distribution block means.

10. The melt spinning apparatus as defined in claim 9 further comprising metering pump means mounted between said leg sections and communicating with each of said melt supply lines of said pump block means.

11. The melt spinning apparatus as defined in claim 1 wherein each of said nozzle assemblies includes a cavity defined on the upper side of said spin plate, a piston mounted in said cavity for axial movement in a direction between said connecting plug and said spin plate, said piston having an opening extending therethrough and which is in alignment with said melt supply line, and diaphragm means positioned in said cavity between said piston and said spin plate for biasing said piston against said connecting plug upon pressurized melt being received in said cavity.

12. A melt spinning apparatus adapted for dividing a molten polymer into a plurality of streams to form synthetic filaments, and comprising an elongate heating chamber having a generally U-shaped outline in cross section and so as to define two parallel leg sections of hollow, double wall construction, with said leg sections extending horizontally and being vertically spaced apart, and with the bottom one of said leg sections defining an upper surface, and a plurality of longitudinally spaced apart tubular nozzle casing receptacles extending vertically through said bottom one of said leg sections, pump block means resting upon said upper surface of said bottom one of said leg sections so as the completely cover each of said nozzle casing receptacles, with said block means including a bottom surface opposing said upper surface of said bottom portion, and a plurality of connecting plugs directly mounted to said bottom surface and aligned with respective ones of said receptacles, and with each of said connecting plugs including a lower face which is disposed at a level above said upper surface of said bottom one of said leg sections, and further including a melt supply line extending through said block means and each of said connecting plugs, metering pump means disposed between said leg sections of said heating chamber and operatively connected to said pump block means for pumping the melt through each of said melt supply lines, and a nozzle assembly mounted within each of said receptacles, with each of said nozzle assemblies including a spin plate having a plurality of openings extending therethrough, and a tubular cajing enclosing and supporting said spin plate and so as to define a cavity on the upper side of said spin plate, and means releaseably interconnecting said casing to the associated connecting plug of said block means and such that said melt supply line communicates with said cavity and thus the upper side of said spin plate, and whereby each nozzle assembly may be released from the associated connecting plug and withdrawn vertically downwardly through the associated receptacle.

13. The melt spinning apparatus as defined in claim 12 wherein each of said nozzle assemblies further includes a piston mounted in said cavity for axial movement in a direction between said connecting plug and said spin plate, said piston having an opening extending therethrough and which is in alignment with said melt supply line, and diaphragm means positioned in said cavity between said piston and said spin plate for biasing said piston against said connecting plug upon pressurized melt being received in said cavity.

14. The melt spinning apparatus as defined in claim 13 wherein each of said nozzle assemblies further includes an annular gasket interposed between said piston and said connecting plug and coaxially aligned with said melt supply line.

* * * * *